US007367402B1

(12) United States Patent
Bangert

(10) Patent No.: US 7,367,402 B1
(45) Date of Patent: May 6, 2008

(54) BLOW-OUT PREVENTOR MAKE/BREAK TOOL

(75) Inventor: Daniel S. Bangert, Broussard, LA (US)

(73) Assignee: McCoy Corporation, Alberta (CA)

( * ) Notice: Subject to any disclaimer, the term of this patent is extended or adjusted under 35 U.S.C. 154(b) by 237 days.

(21) Appl. No.: 11/031,409

(22) Filed: Jan. 7, 2005

Related U.S. Application Data

(60) Provisional application No. 60/535,864, filed on Jan. 12, 2004.

(51) Int. Cl.
*E21B 23/00* (2006.01)

(52) U.S. Cl. ..... 166/378; 166/377; 166/379

(58) Field of Classification Search ..... 166/379, 166/378, 380, 377; 175/85
See application file for complete search history.

(56) References Cited

U.S. PATENT DOCUMENTS 3,507,174 A * 4/1970 Dickmann ..... 81/57.18
4,291,762 A 9/1981 Gudgel
4,294,314 A 10/1981 Miyagishima et al.
4,732,061 A * 3/1988 Dinsdale ..... 81/57.34
6,793,021 B1 * 9/2004 Fanguy ..... 166/380

OTHER PUBLICATIONS

Diagram of Varco PH-85 pipe handling device on sale in the U.S. prior to Jan. 1, 2003.
Description of Varco HT and API 7K DB Tong manual tongs on sale in the U.S. prior to Jan. 1, 2003.

* cited by examiner

*Primary Examiner*—Jennifer H. Gay
*Assistant Examiner*—Brad Harcourt
(74) *Attorney, Agent, or Firm*—Jones, Walker, Waechter, Poitevent, Carrere & Denegre, L.L.P.

(57) ABSTRACT

The present invention provides a tubular make/break tool having a body section and a center weldment positioned within the body section. There are at least two linear actuators in opposed orientation disposed in the body section and the linear actuators are connected to the center weldment in a manner to impart torque thereto.

24 Claims, 12 Drawing Sheets

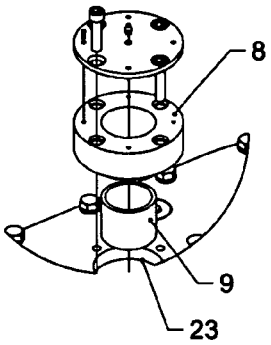
FIGURE 4B
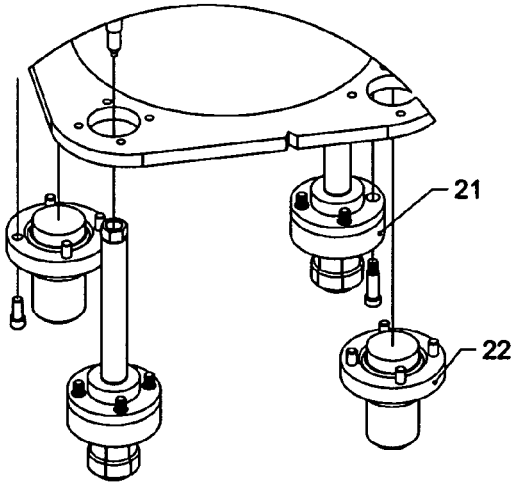
FIGURE 4C
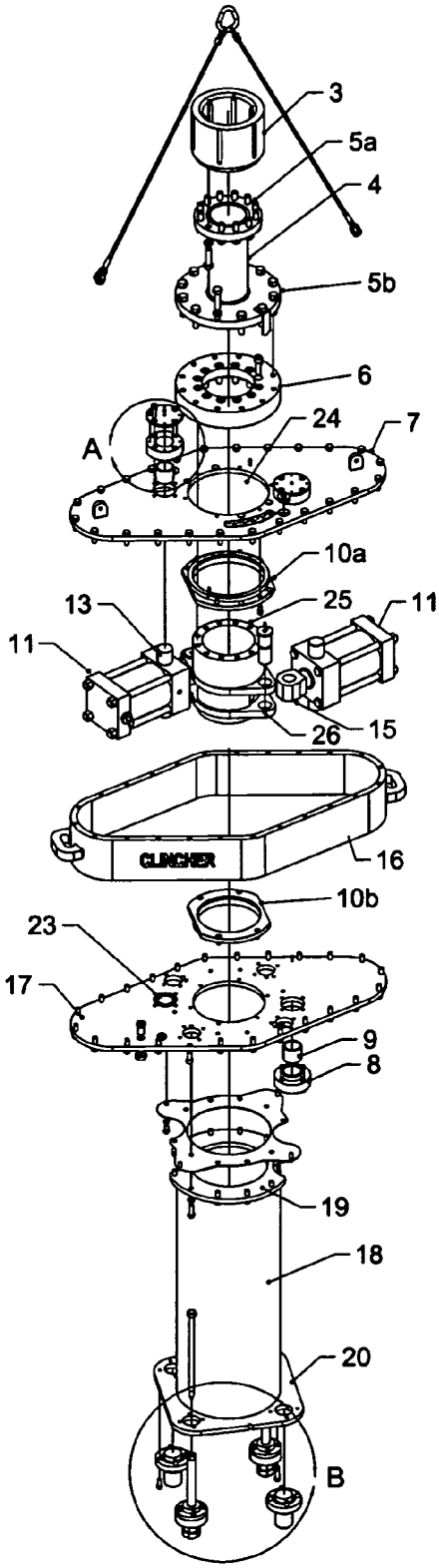
FIGURE 4A
FIGURE 4

DETAIL B

BLOW-OUT PREVENTOR MAKE/BREAK TOOL

This application claims the benefit of priority under 35 U.S.C. § 119(*e*) to U.S. provisional application Ser. No. 60/535,864 filed Jan. 12, 2004 and Ser. No. 60/567,229 filed May 1, 2004, both of which are incorporated by reference herein in their entirety.

FIELD OF INVENTION

The present invention relates to devices for applying torque to the connecting joints between oilfield tubulars. In particular, the present invention relates to devices for applying torque to internal blowout preventers used with top drive assemblies.

BACKGROUND OF INVENTION

It is well known in the oil and gas drilling industry to equip the upper end of the surface pipe of an oil or gas well with blowout preventer devices to prevent fluid and gases from being blown out of the well in the event a high pressure zone is encountered while drilling. One type of blowout preventer contains fluids and/or gases which would escape through the annulus between the well bore wall and the drill pipe. Another type of blowout preventer contains fluids and/or gases which would escape through the central passage of the drill pipe. These latter types of blowout preventers are known as inside or internal blowout preventers (IBOP's).

The most common IBOP's take the form of a blowout sub which includes a tubular housing containing a valve to control the passage of gas or fluids and threaded ends such that the blowout sub may engage the upset end of a drill pipe on one end and on the other end another threaded member such as the drive sub of a top drive. FIG. 1 illustrates a conventional pipe handling apparatus ("pipe handler") 100 such as the Varco PH-85 provided by Varco International of Houston, Tex. and a top drive assembly 101 having an IBOP sub 104 attached thereto. It will be understood that only particularly relevant elements of pipe handler 100 are shown schematically in the Figures since pipe handler 100 does not form part of the present invention. Top drive assembly 101 includes a drive head 120 having the drive motor, drive gearing, and the threaded drive sub 103 which transmits power from the motor to the lower elements of the drill string. The lifting or lowing of drive head 120 and the following string elements is carried out by a conventional hook and traveling block arrangement 102 and drive head 120 is maintained in alignment over the well bore by a drive head dolly 112 moving along top drive guide rail 111. Pipe handler 100 will include a pipe handler frame 109 whose vertical position relative to drive head 120 may be adjusted with pipe handler lift cylinder 113. Pipe handler frame 109 includes internally splined torque tube 108 and clamp cylinder assembly 110. Although not explicitly shown in FIG. 1, those skilled in the art will understand that torque tube 108 will be connected to a torque generating means such that torque tube 108 can impart torque to elements of the drill string as described below. Likewise, it will be understood that clamp cylinder assembly 110 is constructed such that it can grip a string element and hold it stationary against the torque generated by torque tube 108.

The IBOP sub 104 seen in FIG. 1 includes an upper IBOP valve 105 threaded to drive sub 103 at connection 125*a*, lower IBOP valve 107 threaded to upper IBOP valve 105 at connection 125*b*, and sub-saver connector end 113 threaded to lower IBOP valve 107 at connection 125*c*. Typically upper IBOP valve 105 is the primary IBOP valve and may be remotely controlled while lower IBOP valve 107 is a manually opened and closed secondary valve used as a backup to upper IBOP valve 105. Upper IBOP valve 105 also differs from lower IBOP valve 107 in that IBOP valve 105 has a series of splines 106 on its external surface. To help illustrate the environment in which pipe handler 100 and blowout sub 104 are employed, FIG. 1 also illustrates a drill deck or rig floor 118 having a conventional rotary table 117 position therein. Rotary table 117 includes a conventional manual slip assembly 114 which maintains the vertical position of drill pipe 116 (and the drill string below it) when drill pipe 116 is not engaging sub saver 113 and capable of being supported by hook and traveling block assembly 102.

When it is desired to make up or break out the connection between a section of drill pipe 116 and sub saver 113 (i.e. connection 125*d*), pipe handler 100 is moved into the position seen in FIG. 2. Clamp cylinder assembly 110 grips the top joint end of drill pipe 116 while splined torque tube 108 engages the external splines 106 on upper IBOP valve 105. It will be understood that connections 125*a*, 125*b*, and 125*c* are made up at higher torque values than connection 125*d*. Thus, when torque tube 108 applies torque to splines 105 while clamp cylinder assembly 110 holds pipe 116 stationary, connection 125*d* may be made up or broken out. Moreover, connection 125*a* is made up to a higher torque value than any of connections 125*b*-125*d* in order to ensure that connection 125*a* is not inadvertently broken. As a further precaution in certain drilling operations (such as those employing the IBOP's illustrated in the figures), the torque to which connection 125*a* is made up will be greater than the torque which can be generated by drive head 120.

Since connection 125*a* is made up to a torque value higher than connections 125*b*-125*d* and it may not be possible to break out connection 125*a* with the torque generated by drive head 120, the prior art practice was typically to have a person breakout joint 125*a* and upper IBOP valve 105 using some type of large manual wrench, a/k/a "rig tongs." It is also typical that connection 125*a* will be at an elevated position above the rig floor, requiring the worker breaking out connection 125*a* to mount a step ladder or some type of elevated structure to properly access connection 125*a*. This present procedure both causes unacceptable delays in expensive drilling operations and presents fall and other injury hazards for workers. What is needed in the art is a tool overcoming the disadvantages which exist in the current procedure for breaking out or making up connections such as found in IBOP sub assemblies.

SUMMARY OF INVENTION

The present invention provides a tubular make/break tool having a body section and a center weldment positioned within the body section. There are at least two linear actuators in opposed orientation disposed in the body section and the linear actuators are connected to the center weldment in a manner to impart torque thereto.

The present invention also provides a method of making up or breaking out an internal blow-out preventer positioned above a drilling deck. The method includes the step of providing a make/break tool comprising: i) a tubular base section; ii) a torque generating section positioned above the base section; and iii) a tool gripping section attached to and extending above the torque generating section. The tubular base section of the make/break tool is then positioned over a pipe length extending above the drilling deck and beneath the internal blow-out preventor. Then the internal blow-out preventer is engaged with the tool gripping section and the torque generating section is engaged in order to make-up or break-out the internal blow-out preventor.

BRIEF DESCRIPTION OF DRAWINGS

FIG. 4 is a perspective exploded view of the make/break tool of the present invention.

DETAILED DESCRIPTION OF INVENTION

Figure 1:
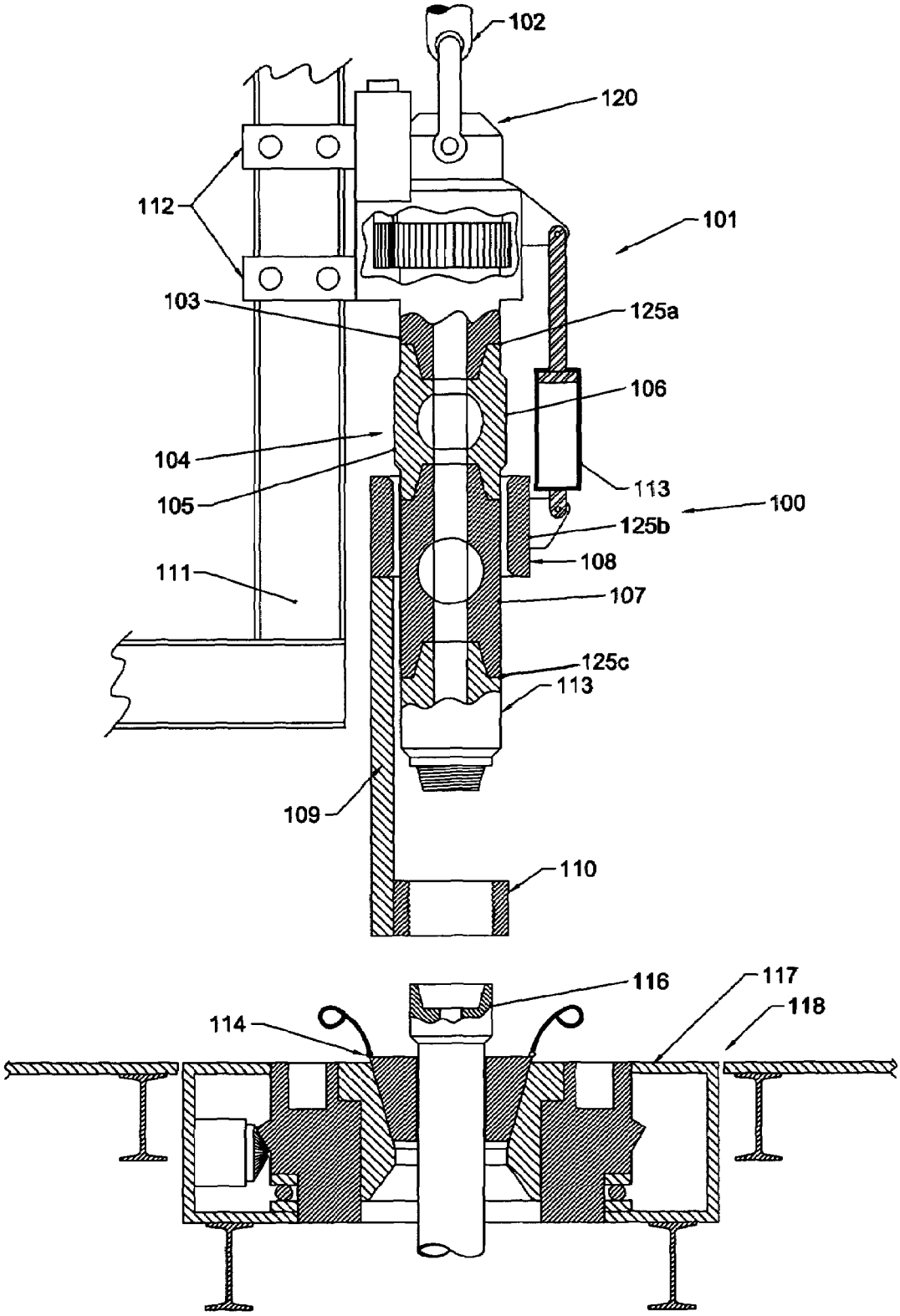
FIG. 1 is side view of a prior art pipe handling system with an IBOP attached thereto and a section of drill pipe resting in slips on the floor of a drilling rig.
Figure 3:
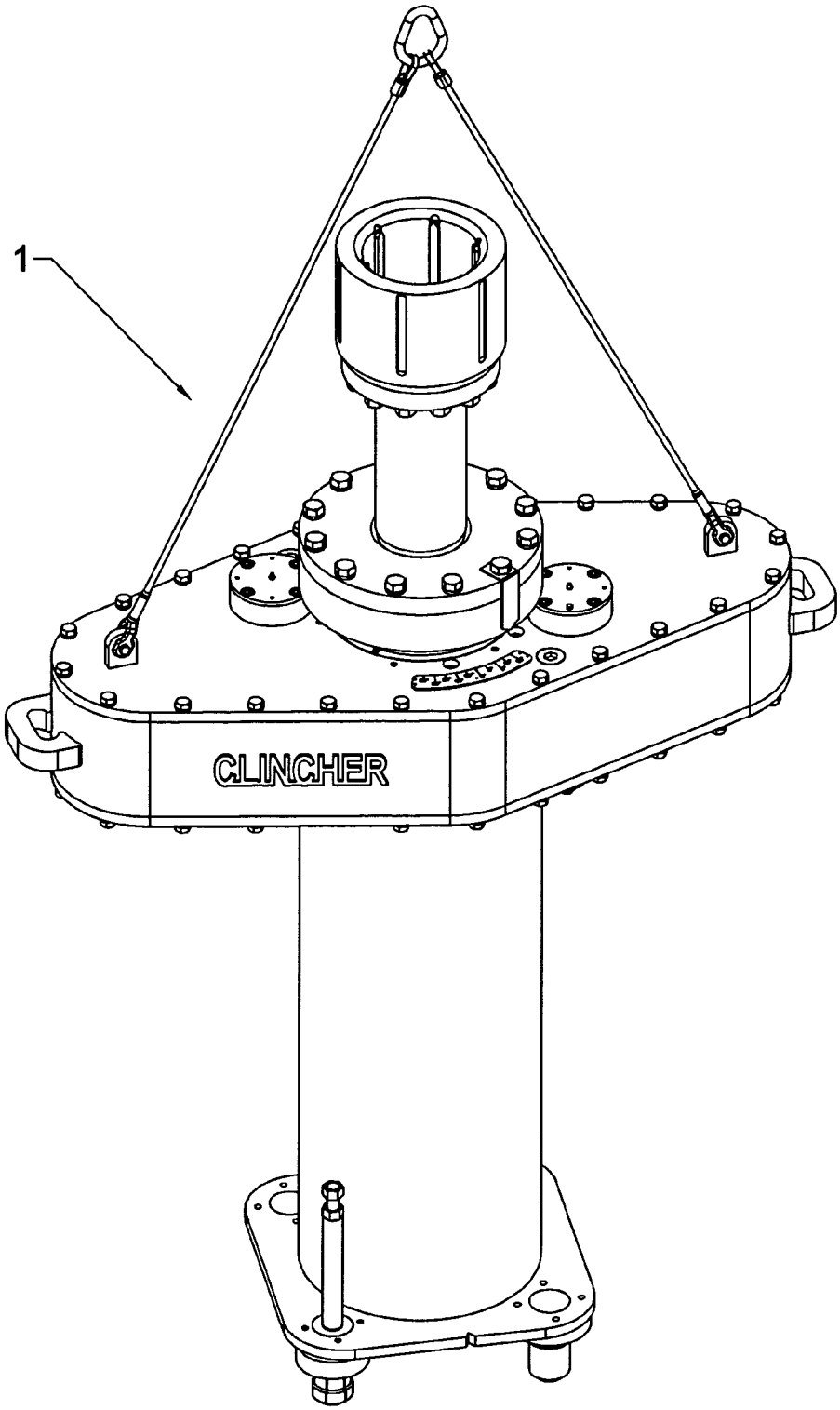
FIG. 3 is a perspective view of the assembled make/break tool of the present invention.

One embodiment of make/break tool 1 is seen in its assembled state in FIG. 3 and in an exploded view in FIG. 4. Make/break tool 1 will generally comprise a tubular base section, a torque generating section, and a tool gripping section. In the embodiment shown, the tool gripping section will be spline connector 3 having grooves which mate with external splines 106 on upper IBOP sub 105 (see FIG. 1). Spline connector 3 is bolted or otherwise fixed to upper extension weldment 4 by way of upper connector plate 5*a*. In addition to upper connector plate 5*a*, upper extension weldment 4 includes a bottom connector plate 5*b*, which is in turn bolted onto flange 6.

The torque generating section in FIG. 4 is contained in body section or mid-body weldment 16. Flange 6 is connected to rotating center collar or center weldment 25 through top plate opening 24. An upper bushing 10*a* of a suitable bearing material such as bronze will be positioned between flange 6 and center weldment 25. Upper bushing 10*a* will provide a bearing surface if any vertical or radial loads are generated between flange 6 and center weldment 25. Both center weldment 25 and two piston and cylinder assemblies 11 are enclosed by top plate 7, bottom plate 17, and mid-body weldment 16. Two bushings 9 covered by caps 8 are positioned on each side of flange 6. Bushings 9 will provide bearing surfaces for trunnions 13 on piston and cylinder assemblies 11 as described below. A lower set of bushings 9 with bushing caps 8 are positioned on bottom plate 17 and serve the same function as described above. Center weldment 25 includes two sets of pinning ears 26 which provide the pinned connection to the rod ends 15, and provide the means for piston and cylinder assemblies 11 to impart torque to center weldment 25. Piston and cylinder assemblies 11 are pivotally mounted in mid-body weldment 16 by way of trunnions 13 engaging bushings 9 which are positioned in apertures 23 formed in top plate 7 and bottom plate 17. In this embodiment, the rear portions of piston and cylinder assemblies 11 need not be secure in mid-body weldment 16. However, in alternative embodiments, the rear of piston and cylinder assemblies 11 could be pivotally connected to the top and bottom plates and the front of piston and cylinder assemblies 11 remain unattached. The particular manner of connection is not critical as long as piston and cylinder assemblies 11 may pivot sufficiently to accommodate the rotation of center weldment 25. It can be seen in FIG. 4 how piston and cylinder assemblies 11 are positioned in an opposed arrangement around center weldment 25. It will be understood that double acting piston and cylinder assemblies typically extend the piston rods with greater force that with which the rods are retracted. This is because the rear surface of the piston has a greater area for the driving fluid to act upon than the front surface of the piston (to which the rod is attached). The piston and cylinder assemblies 11 will be oriented such that the cylinders extend to provide torque in the breakout direction and retract to provide torque in the make-up direction. Thus, the make/break 1 tool will always be able to provide greater torque in the break-out direction and should not be capable of making up a connection to a torque which tool 1 cannot also breakout.

In the particular embodiment shown, the rods in piston and cylinder assemblies 11 will have sufficient travel that center weldment 25 can rotate approximately 48° when piston and cylinder assemblies 11 expand and contract their piston rods. In one preferred embodiment, piston and cylinder assemblies 11 are 8 inch bore cylinders operating at a fluid pressure of about 2000 p.s.i. Naturally, many different types of piston and cylinder assemblies and many other types of linear actuators could be employed in make/break tool 1.

Figure 6:
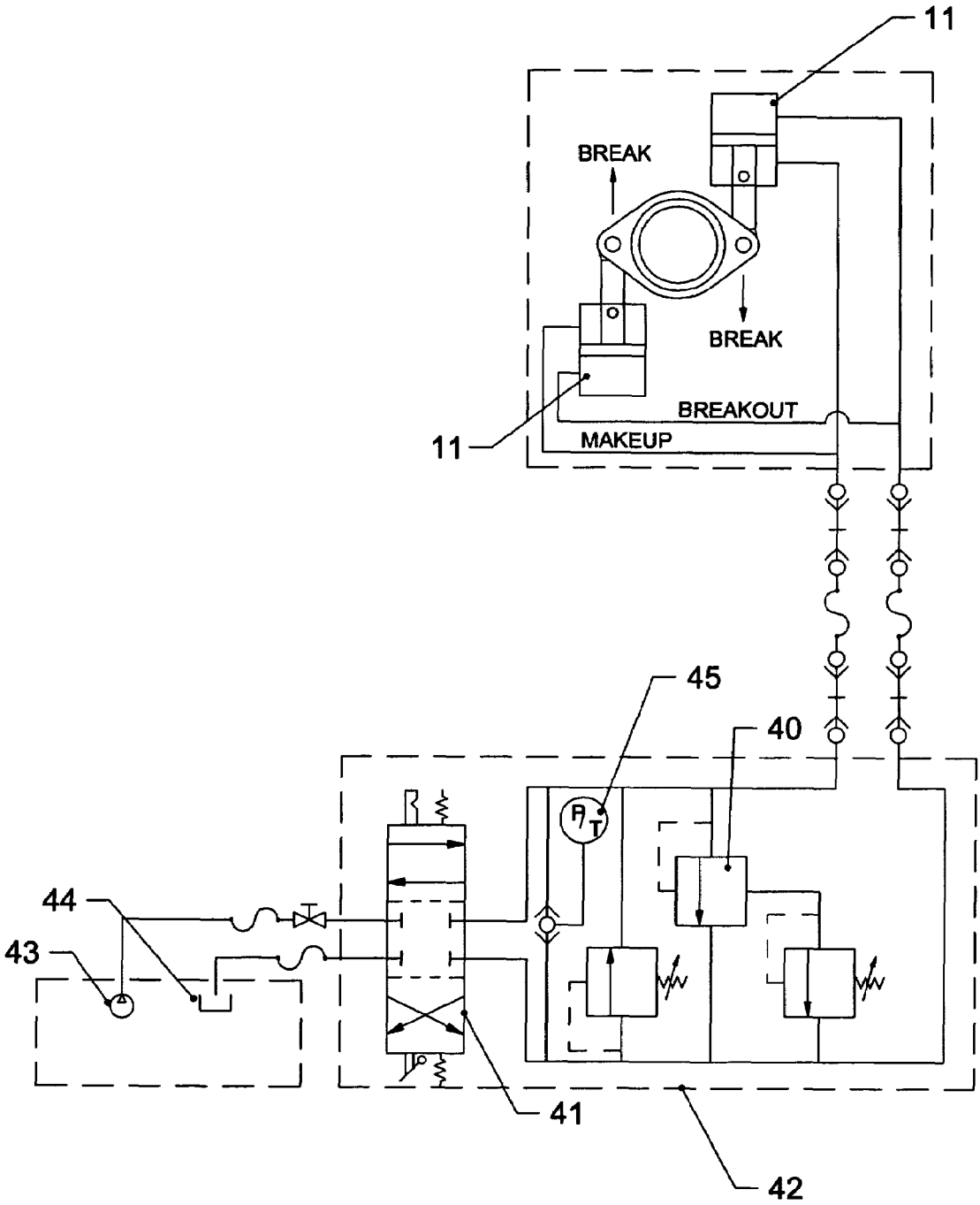
FIG. 6 is a hydraulics schematic relating to the make/break tool's piston and cylinder assemblies.

FIG. 6 illustrates a hydraulics schematic for one embodiment of the make/break tool 1. Double acting piston and cylinder assemblies 11 will be supplied with fluid lines communicating through control panel 42. Control panel 42 will include adjustable relief valves 40 which allow the operator to manually set the maximum fluid pressure delivered to piston and cylinder assemblies 11 and thus control the maximum make up torque applied by tool 1. Control panel 42 will also include direction control valves 41 which direct fluid to either extend or retract the piston rods in piston and cylinder assemblies 11. Control panel 42 will also typically have a pressure gauge 45 indicating the pressure applied to piston and cylinder assemblies 11 and a specially calibrated bezel which indicates torque that is applied based upon the given hydraulic pressure. FIG. 6 also illustrates the pressurized hydraulic fluid supply 43 and a return reservoir 44 communicating through control valve 41.

Figure 8:
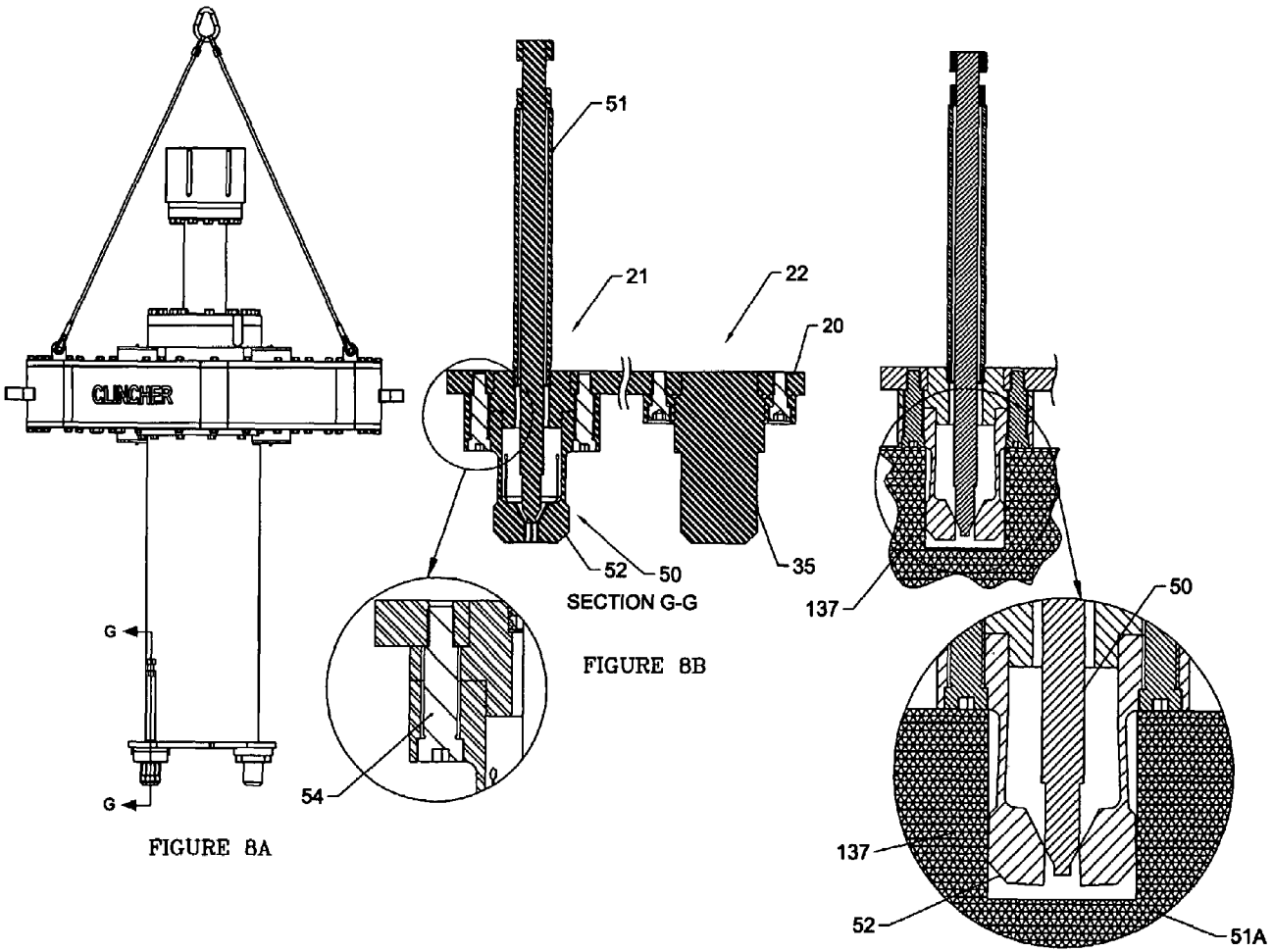
FIG. 8 illustrates a flexible insert assembly employed in the present invention

The tubular base section shown in FIG. 4 will generally comprise lower extension weldment 18. In this embodiment, lower extension weldment 18 is a tubular member approximately 18" in diameter. The length of lower extension weldment 18 will typically be between 48" and 60" depending on the size of the drill pipe, the type of handling device, or the length of any auxiliary IBOP valve positioned within the drill pipe (see FIG. 5). The bottom of lower extension weldment 18 will include footing 20. Attached to two opposing corners of footing 20 are flexible insert assemblies 21 and attached to the remaining two opposing corners are solid insert assembles 22. As best seen in FIG. 8, flexible insert assemblies 21 will be formed of collet assemblies 50. Collet assemblies 50 will generally comprise a metal ring with slots cut therein to form individual fingers 52. Collet bolt 51 may be rotated downward to cause bolt tip 51*a* to engage and spread collet fingers 52. In one embodiment, collet fingers 52 will be coated with a high friction granular particle coating such as disclosed in U.S. Pat. No. 6,378,399, which is incorporated by reference herein.

When footing 20 is positioned on rotary table 117, both flexible insert assemblies 21 and solid insert assemblies 22 will engage existing Kelly drive bushing socket apertures 137 in rotary table 117. After tightening collet bolts 51, collet assemblies 50 will resist upward movement of footing 20 and help resist overturning forces applied to make/break tool 1. However, collet assemblies 50 are attached to footing 20 with shoulder bolts 54 which allow some movement of collet assemblies 50 in the lateral direction (i.e., within the plane of footing 20). On the other hand, solid insert assemblies 22 will comprise solid lugs 35 which are rigidly connected to footing 20. Solid lugs 35 will allow no movement in the lateral direction when they engage apertures 137. In this manner, solid lugs 35 will resist any lateral forces placed on footing 20 (e.g., such as torque caused by the operation of make/break tool 1) and these lateral forces will not be transferred to collet assemblies 50.

Figure 5:
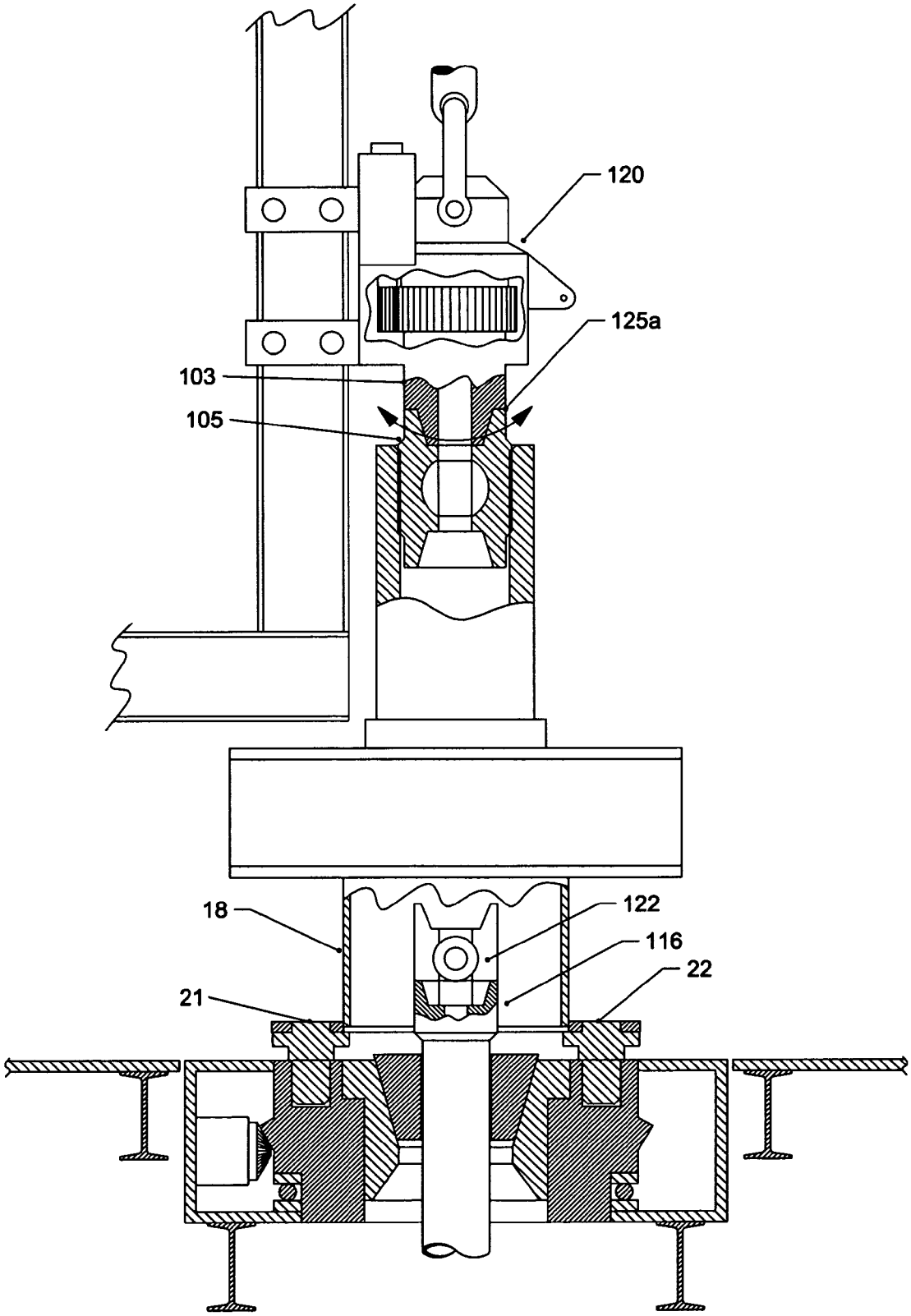
FIG. 5 illustrates how the make/break tool would be employed on a drilling rig.

FIG. 5 illustrates how make/break tool 1 will be placed into operation. Prior to placement of make/break tool 1 over drill pipe 116, pipe handler frame 109, sub saver 113 and lower IBOP 107 (see FIG. 1) are all removed, leaving upper IBOP 105 connected to drive sub 103. The lower extension weldment 18 of make/break tool 1 is capable of being positioned over drill pipe 116 and auxiliary IBOP valve 122 due to its tubular nature. The footing 20 on lower extension weldment 18 connects to rotary table 117 by way of flexible and solid inserts 21 and 22 and rotary table 117 is locked against rotation using its existing locking mechanism. Then upper IBOP 105 is lowered until its external splines 106 engage spline connector 3 on make/break tool 1.

Figure 2:
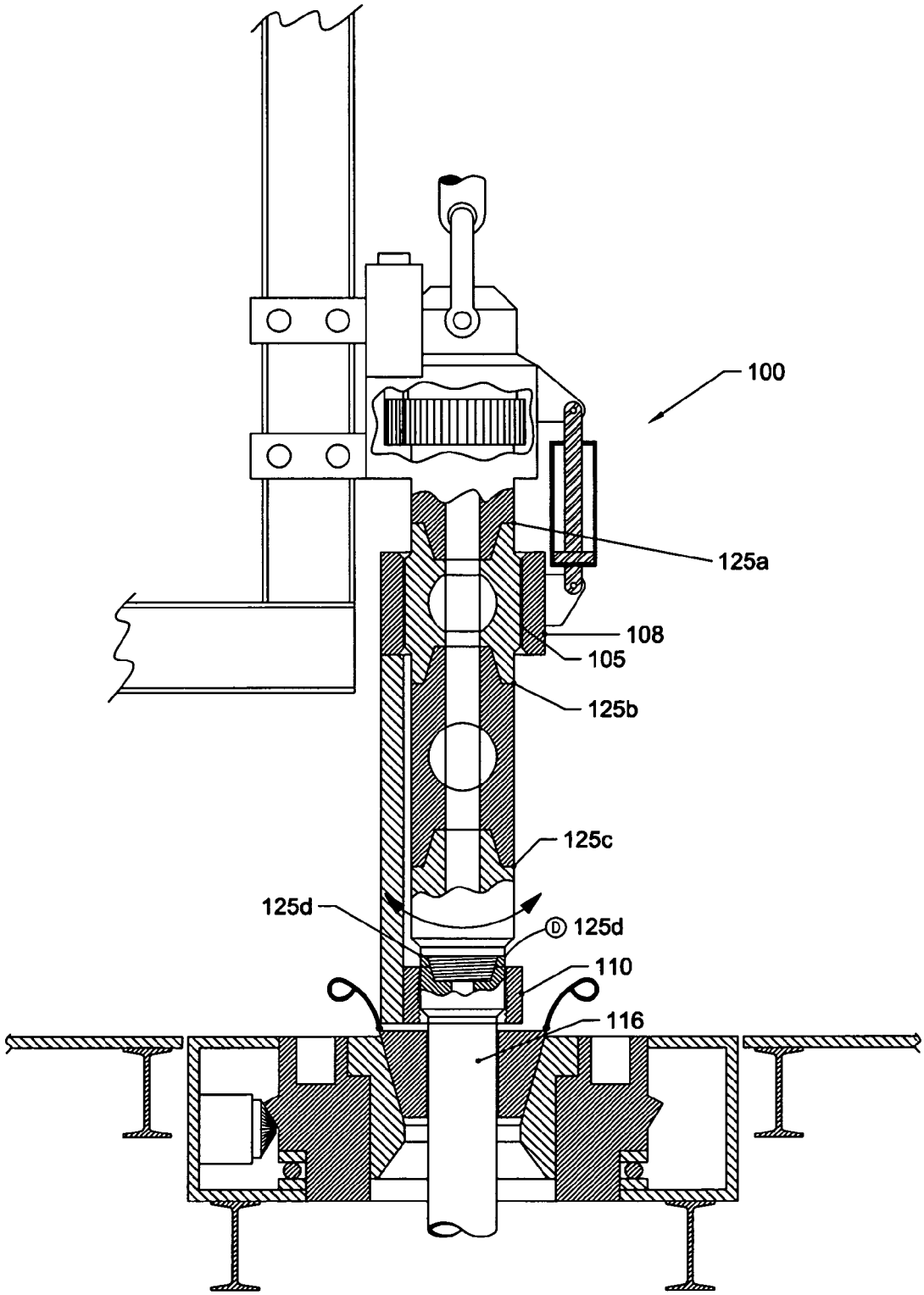
FIG. 2 is the pipe handling system of FIG. 1 with the IBOP engaging the drill pipe.
Figure 7:
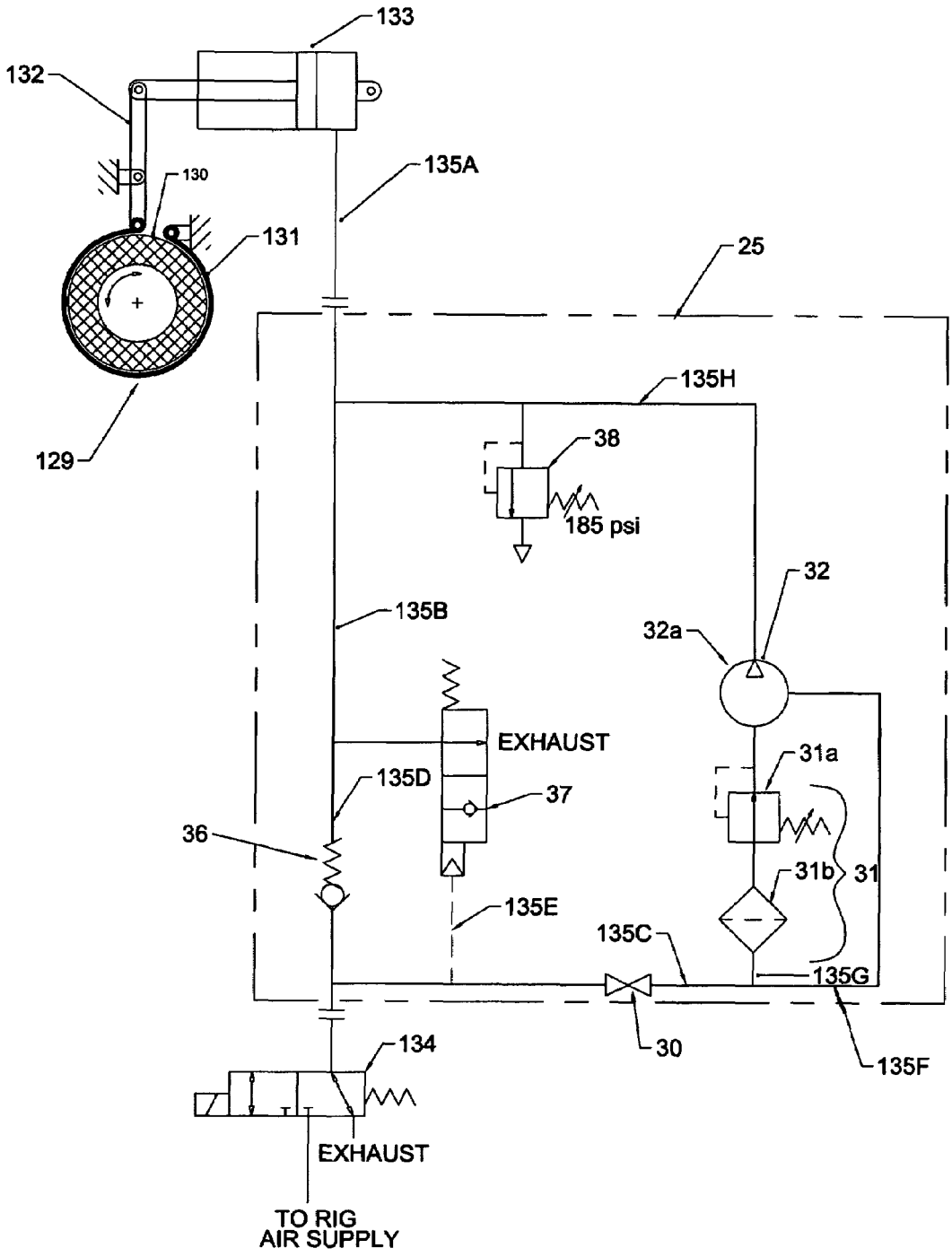
FIG. 7 is a hydraulics schematic of a booster for the drive brake cylinder of the present invention.

Prior to make/break tool 1 applying torque to upper IBOP 106 to break out (or make up) connection 125*a*, the transmission in drive head 120 must be secured against rotation or the torque will be transferred to the transmission and not resisted at connection 125*a*. FIG. 7 illustrates schematically how the present invention will include a brake cylinder booster mechanism 25 which will assist the conventional drive head brake system 129 to hold the drive motor against the torque produced by make/break tool 1 when breaking out connection 125*a*. Conventional brake system 129 includes a brake band 131 encircling the motor shaft 130 of drive head 120. Brake band 131 will be activated (i.e. tightened around motor shaft 130) by the operation of brake piston 133 upon brake arm 132 as is well known in the art. Pressurized air will be provided to brake piston 133 through solenoid operated valve 134. When it is desired to make up or break out connections 125*b* and 125*c* (FIG. 2), brake mechanism 129 is activated to hold motor shaft 130 stationary while torque is applied below the connection being made up or broken out. However, as mentioned above, connection 125*a* is made up at a higher torque level which cannot be inadvertently broken out. Thus, the torque required to break connection 125*a* will normally exceed the holding capacity of braking mechanism 129, causing motor shaft 130 to rotate before connection 125*a* will break.

To overcome this limitation in braking mechanism 129, the present invention provides booster mechanism 25 as seen in FIG. 7. Solenoid operated valve 134 will be connected to an existing rig air supply and function to selectively provide air to booster mechanism 25. Booster mechanism 25 includes booster valve 30, an elevated supply source 32, and an air filter/regulator assembly 31 positioned in line segment 135*g*. In a normal operating or non-boost mode, booster valve 30 is in a closed position to block the flow of air. Upon the activation of valve 134, compress air flows from the rig supply through check valve 36 and lines 135*d*, 135*b*, and 135*a*. It will be understood that although exhaust valve 37 is biased in the open position to vent pressurized air in lines 135*b* (and lines connected thereto) when valve 134 is closed, opening valve 134 directs pressurized air into line 135*e*, thereby closing exhaust valve 37. With exhaust valve 37 closed, compressed air flows through line segments 135*a*, *b*, and *d* to brake piston 133, causing brake piston 133 to activate braking mechanism 129. As an example, the lower pressure source (i.e. rig supply) might provide air compressed at 120 p.s.i.

To operate in a boost mode, control valve 30 is moved to the open position to permit the flow of air from the lower pressure source into and through line segment 135*c*. Line 135*c* splits into lines 135*g* and *f*. Line 135*g* serves as the supply line for compressed air needed to operate elevated pressure source 32. In the illustrated embodiment, elevated pressure source 32 is a conventional compressor 32*a* which utilizes air supplied from line 135*g* to power pistons which in turn compress the air supplied from line 135*f*. In another embodiment of the invention, elevated pressure source 32 could be an existing source of compressed air in an appropriate container or tank at an elevated pressure, thus eliminating the need for a compressor system. However, these are just two examples of elevated pressure sources and the present invention is intended to encompass any mechanism for elevating pressure which can function effectively with the invention.

Air filter/regulator assembly 31 is positioned within line 135*g*. The air filter 31*b* serves the purpose of filtering particulate matter and water from the air entering the regulator 31*a* and compressor 32*a*. The regulator 31*a* controls the pressure of the air obtained from line 135*c* which is used to operate compressor 32*a*. In the embodiment shown, compressor 32*a* will elevate the pressure of the air being compressed by a given ratio (e.g. 3:1) of the air pressure driving the compressor (i.e. air from regulator 31*a*). In order to obtain the desired output pressure, regulator 31*a* adjusts the compressor driving pressure accordingly. For example, if the desired output is 180 psi and the compression ratio is 3:1, regulator 31*a* would reduce the pressure from line 135*c* to 60 psi. Line 135*f* supplies the air to compressor 32*a* that is to be compressed to the desired output pressure (i.e., the air supplied by line 135*f* is the air that will eventually be compressed and be directed to brake piston 133). It will be readily apparent that the level of increased pressure generated by compressor 32*a* could vary depending on the application and brake mechanism being used. The level of pressure will mainly depend on what is necessary to hold motor shaft 130 against the torques expected to be applied to it. As one nonlimiting example, the air supplied to brake piston 133 may be elevated to approximately 180 psi. A pop off valve 38 is positioned between compressor 32*a* and brake piston 133. Pop off valve 38 is activated by the air in line 135*h* exceeding a predetermined pressure, for example 185 p.s.i.

Viewing FIGS. 5 and 7, it will be clear that once booster mechanism 25 is activated and motor shaft 130 securely braked, piston and cylinder assemblies 11 can supply sufficient torque to break out or make up connection 125*a*. Once connection 125*a* is made up or broken out, make/break tool 1 is removed from its position over drill pipe 116 and drilling operations are allowed to proceed unimpeded.

Figure 9:
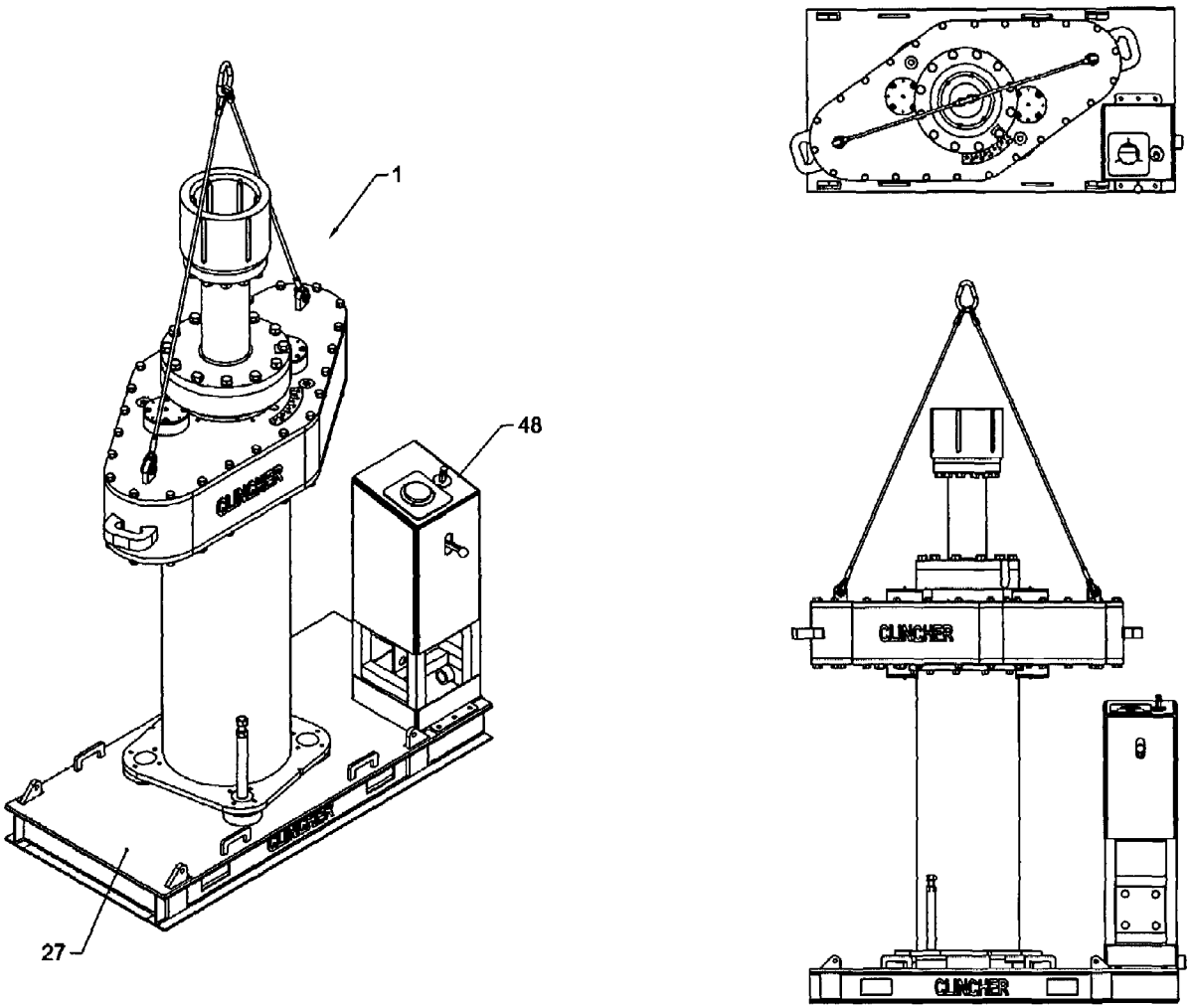
FIG. 9 illustrates a skid attachment for the make/break tool.

FIG. 9 illustrates make/break tool 1 mounted on skid 27. Skid 27 will provide a platform for shipping make/break tool 1 and storing it when it is not in actual operation. FIG. 9 also illustrates how skid 27 provides a mounting surface for control console 48 which will include the control panel 43 (see FIG. 6) and be used to control the operation of make/break tool 1 when in use. Although not explicitly shown, it will be understood that hydraulic lines will be connected between control console 48 and make/break tool 1.

Figure 10:
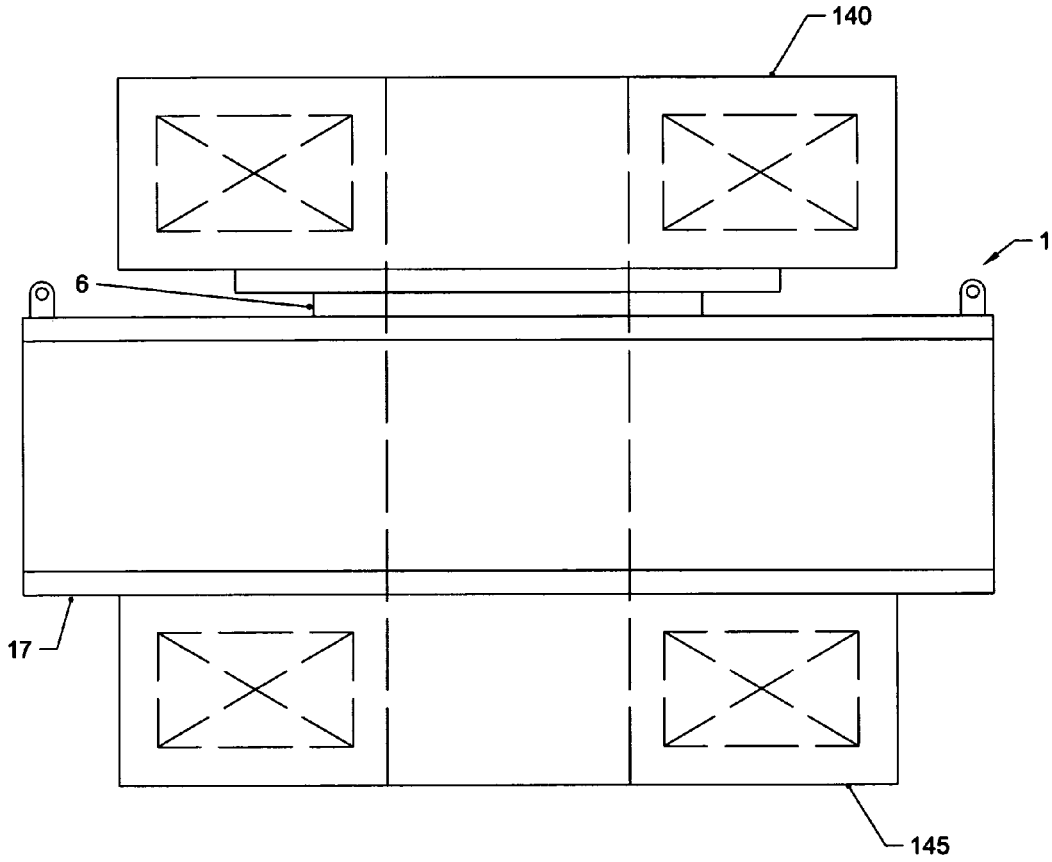
FIG. 10 illustrates an alternate embodiment of the make/break tool.

An alternative embodiment of make/break tool 1 is shown schematically in FIG. 10. In this embodiment, make break/tool 1 is shown with both upper extension weldment 4 and lower extension weldment 18 removed. In their place, a first conventional backup tong 140 has been connected to flange 6 and a second conventional backup tong 145 has been connected to bottom plate 17. Both conventional backup tongs 140 and 145 will have a gripping means well known in the art such as arcuate jaws mounted on piston and cylinder assemblies (see for example U.S. Pat. No. 4,649,777 which is incorporated by reference herein) which are designated by the letter "A". Backup tongs 140 and 145 will be "round" or "closed throat" tongs as are well known in the art. In operation, the threaded pipe or tubular connection to be made up or broken out will be passed through the backup tongs and the opening in center weldment 25. Backup tong 140 will grip one side of the joint and backup tong 145 will grip the opposite side. The rotation of center weldment 25 by piston and cylinder assemblies 11 as described above will impart torque to backup tong 140 (and thus one side of the tubular joint) while backup tong 145 held the other side of the joint against rotation. In effect, this embodiment of make/break tool 1 is performing the function of a conventional power tong and backup combination.

Figure 11:
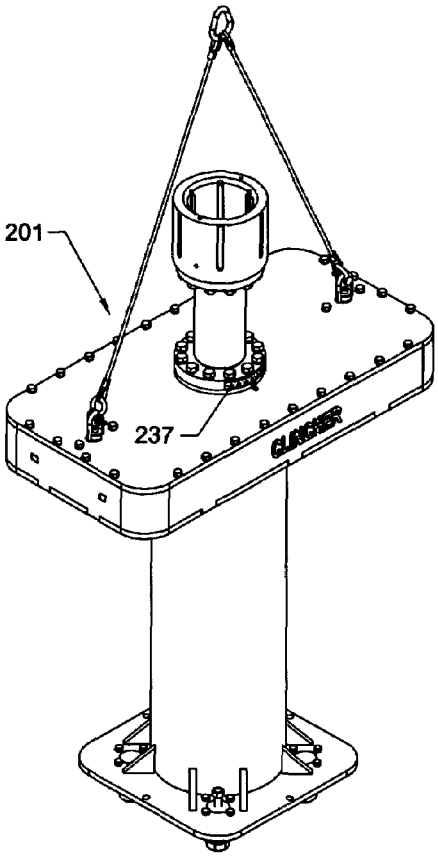
FIG. 11 illustrates a perspective view of another embodiment of the assembled make/break tool.
Figure 12:
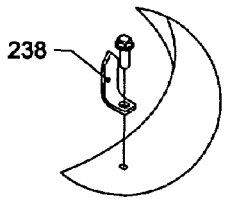
FIG. 12 illustrates a perspective exploded view of this embodiment of the make/break tool.
Figure 12:
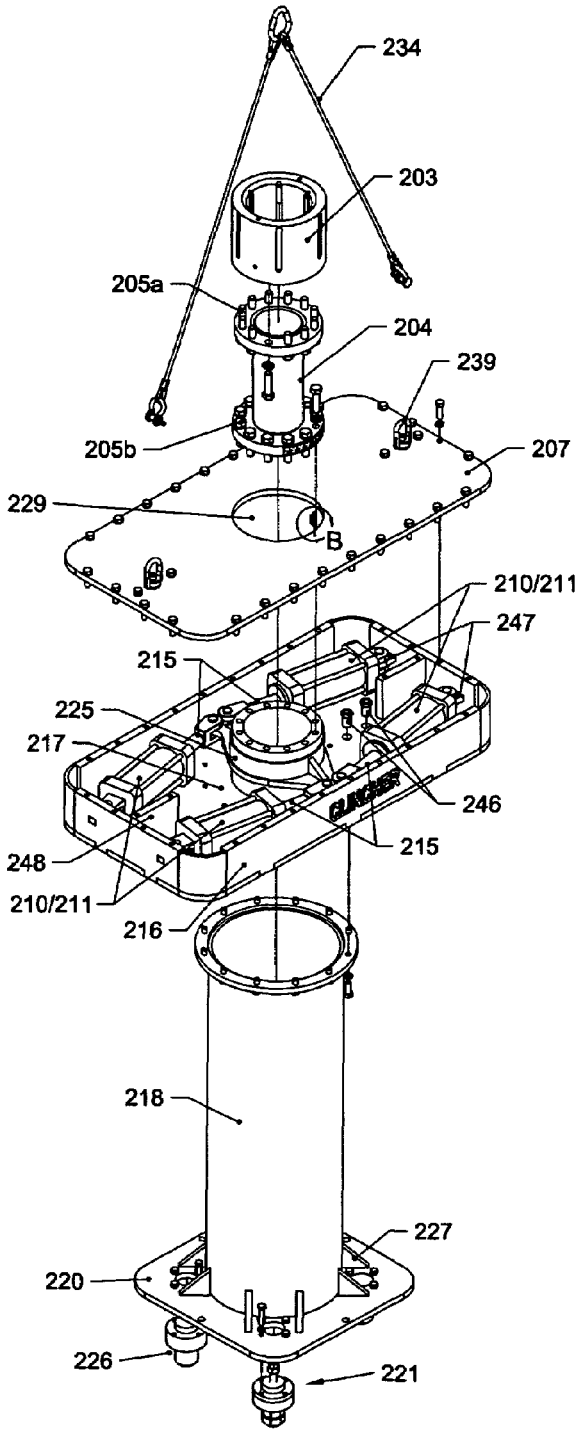
Figure 13:
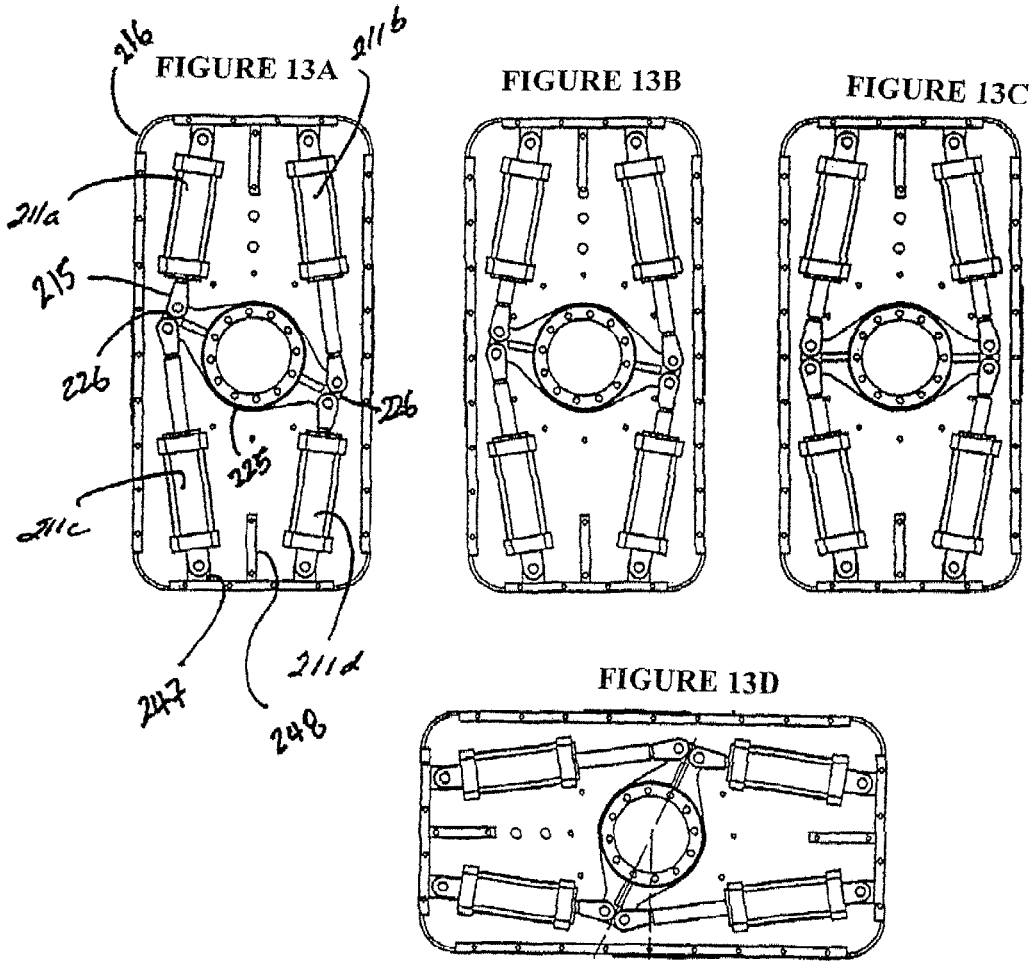
FIG. 13 illustrates an overhead view of the body or torque generating section of this embodiment of the invention.

Another alternate embodiment of the invention is shown as make/break tool 201 in FIGS. 11-13. As illustrated in FIG. 11, make/break tool 201 generally comprises a tool gripping section, a body or torque generating section, and a tubular base section. FIG. 12 shows an exploded view of make/break tool 201. In the embodiment illustrated, the tool gripping section generally comprises spline connector 203 and upper extension weldment 204. Spline connector 203 is bolted or otherwise fixed to top of upper extension weldment 204 by way of upper connector plate 205*a* and comprises the same grooves for engaging the external splines 106 on upper IBOP sub 105 (see FIG. 1) as discussed in connection with the previously described embodiment. Bottom connector plate 205*b* is connected to the bottom of upper extension weldment 204, and also connects upper extension weldment 204 to rotating center collar or center weldment 225 through top plate opening 229. As shown on FIG. 11, the side of bottom connector plate 205*b* comprises markings 237 for determining rotational movement of upper extension weldment 225 relative to pointer 238 located on top plate 207. In the particular embodiment illustrated, markings 237 are measured in degrees of angle.

The body or torque generating section generally comprises top plate 207, mid-body weldment 216, bottom plate 217, center weldment 225 and linear actuators 210. In the illustrated embodiment, linear actuators are piston and cylinder assemblies 211. As shown in FIG. 12, center weldment 225 and piston and cylinder assemblies 211 are enclosed by top plate 207, bottom plate 217 and mid-body weldment 216. Top plate 207 includes top plate opening 229 and two sling supports 239 for attaching sling 234 to make/break tool 201. Top plate 207 connects to mid-body weldment 216 using a series of bolts positioned around the perimeter of top plate 207. Bottom plate 217 includes a pair of bulkhead connectors 246 which are used to attach hydraulic hoses to the tool by way of quick disconnects.

FIGS. 13*a* to 13*d* show an upper view of the torque generating section with top plate 217 removed. Center weldment 225 includes two pair of ears 226 which serve as pivotal connection points for connecting rod ends 215 of piston and cylinder assemblies 211 to center weldment 225. The opposite end of each piston and cylinder assembly 211 is pivotally connected to an ear 247 positioned on the inner wall of mid-body weldment 216. As illustrated, four piston and cylinder assemblies 211 are positioned within the boundaries of mid-body weldment 216, with a pair of piston and cylinder assemblies 211 being located on each side of center weldment 225. Gussets 248 serve to reinforce the end plates to which ears 226 are attached.

For purposes of illustrating the rotation capabilities of center weldment 216, the piston and cylinder assemblies 211 in FIGS. 13*a* through 13*d* are labeled as 211*a*, 211*b*, 211*c* and 211*d* respectively. In FIG. 13*a*, the rods of piston and cylinder assemblies 211*b*, 211*c* are fully extended, and the rods of piston and cylinder assemblies 211*a*, 211*d* are fully retracted, thereby forcing center weldment 225 to be rotated in the position illustrated. In the particular embodiment illustrated in FIG. 13*a*, and as noted in FIG. 13*d*, center weldment 225 is rotated clockwise at a 24.5 degree angle relative its horizontal axis. FIGS. 13*b* through 13*c* illustrate transformational changes of piston and cylinder assemblies 211*a* through 211*d* required to rotate center weldment 225 approximately 24.5 degrees in a counterclockwise rotational direction. FIG. 13*d* shows the rods of piston and cylinder assemblies 211 being all extended an equal distance resulting in center weldment 225 being positioned horizontally.

As mentioned above, FIGS. 13*a* through 13*c* show the movement of center weldment 225 rotating in a counterclockwise direction from a position that is 24.5 degrees offset as shown in FIG. 13*a*, to a neutral or 0 degree position as shown in FIG. 13*c*. Although not illustrated, piston and cylinder assemblies 211 can move center weldment an additional 24.5 degrees in the counterclockwise direction, thereby giving center weldment an approximate maximum range of rotation of 49 degrees.

The maximum angle at which center weldment 225 can rotate may be altered in other embodiments of the invention by changing the configuration of piston and cylinder assemblies 211 as well as by adjusting the stroke length of the piston and cylinder assemblies 211. The particular embodiment of the invention illustrated in FIG. 12 includes piston and cylinder assemblies 211 having a 5" bore, 10" stroke and a 2" rod. As shown in FIG. 11, the shape of the torque generating section is generally rectangular to accommodate the arrangement of piston and cylinder assemblies 211 located therein. The hydraulic system for make/break tool 201 will be configured and function largely in the same manner as the hydraulic system illustrated in FIG. 6, except being modified to control four piston and cylinder assemblies rather than two.

The tubular base section shown in FIG. 12 will generally comprise lower extension weldment 218. The top of lower extension weldment 218 connects to the bottom of bottom plate 217, while the bottom of lower extension weldment 218 comprises footing 220. Footing 220 includes flexible insert assemblies 221, solid insert assemblies 222, collet assemblies 250, and collet bolts 251 and will function in the same manner as footing 20 discussed in connection with make/break tool 1 illustrated in FIG. 3. As shown in FIG. 12, footing 220 includes braces 227. In one embodiment, the length of lower extension weldment 218 will be approximately 65.5 inches with a minimum inside diameter of approximately 19 inches. Mid-body weldment 216 will have dimensions of approximately 32.5 inches (width) by 63 inches (length) by approximately 10.5 inches (depth), while center weldment 215 will have a minimum inside diameter of approximately 10.125 inches. Of course, other embodiments of make/break tool 201 may have dimensions which vary from the dimensions of this example.

Although the present invention has been described in terms of specific embodiments, those skilled in the art will recognize many obvious variations and modifications. For example, one embodiment could include a tubular make/break tool comprising a tubular base section; a torque generating section positioned above said base section; and a tool gripping section attached to and extending above said torque generating section. Additionally, although the above embodiments discuss at least two linear actuators in opposed orientation around the center weldment, the invention also includes embodiments wherein a single linear actuator or at least one linear actuator operates on the center weldment in a manner to impart torque thereto. All such variations and modifications are intended to come within the scope of the following claims.

I claim:

1. A tubular make/break tool comprising:

a. a body section;

b. a center weldment positioned within said body section; and c. at least two linear actuators oriented to extend in substantially parallel but opposite directions disposed in said body section, said linear actuators connected to said center weldment in a manner to impart torque thereto; and d. a backup tong positioned above said body section and operatively connected to said center weldment.

2. The make/break tool of claim 1, wherein said linear actuators are piston and cylinder assemblies.

3. The make/break tool of claim 1, wherein a tubular base section is connected to a lower part of said body section.

4. A tubular make/break tool comprising:

a. a tubular base section;

b. a body section positioned on said base section, said body portion including at least one linear actuator positioned to engage and rotate a collar on said body section; and c. a tool gripping section attached to and extending above said collar, said tool gripping section including a tool head for engaging a tool to which torque is to be supplied.

5. The make/break tool of claim 4, wherein said linear actuator is a piston and cylinder assembly.

6. The make/break tool of claim 4, wherein said linear actuator and said collar are enclosed within said body section, said body section comprising a mid-body weldment, a top plate, and a bottom plate.

7. The make/break tool of claim 4, wherein said base section has a first height and said body section has a second height, wherein said first height is a least twice as great as said second height.

8. The make/break tool of claim 4, wherein said base section has an internal diameter of between about 12 inches and about 36 inches.

9. The make/break tool of claim 4, wherein said tool head is a splined cylinder.

10. The make/break tool of claim 4, wherein said tool gripping section is separately formed from said collar and bolts to said collar.

11. The make/break tool of claim 4, wherein said base section has a footing plate connected thereto.

12. A method of making up or breaking out an internal blow-out preventor or component thereof positioned above a drilling deck, comprising the steps of:

a. providing a make/break tool comprising: i) a tubular base section; ii) a torque generating section positioned above said base section; and iii) a tool gripping section attached to and extending above said torque generating section;

b. positioning said tubular base section of said make/break tool over a pipe length extending above said drilling deck and beneath said internal blow-out preventor or component thereof;

c. engaging said internal blow-out preventor or component thereof with said tool gripping section; and d. activating said torque generating section in order to make-up or break-out said internal blow-out preventor or component thereof.

13. A tubular make/break tool comprising:

a. a body section;

b. a center weldment positioned within said body section; and c. at least four linear actuators positioned in said body section, wherein said linear actuators are divided into pairs so that a pair of linear actuators is positioned on each side of said center weldment in an opposed orientation, said linear actuators being connected to said center weldment and said body section in a manner to impart torque thereto.

14. The make/break tool of claim 13, wherein said linear actuators are piston and cylinder assemblies.

15. The make/break tool of claim 14, wherein said linear actuators are capable of both extending and retracting.

16. The make/break tool of claim 13, wherein a tubular base section is connected to a lower part of said body section.

17. The make/break tool of claim 16, wherein said base section has a footing plate connected thereto.

18. The make/break tool of claim 16, wherein a tool gripping section is attached to and extends above said center weldment, said tool gripping section including a tool head for engaging a tool to which torque is to be supplied.

19. The make/break tool of claim 18, wherein said tool head is a splined cylinder.

20. A method of making up or breaking out an internal blow-out preventor or component thereof positioned above a drilling deck, comprising the steps of:

a. providing a make/break tool comprising: i) a body section; ii) a center weldment positioned within said body section; and iii) at least two linear actuators disposed in said body section and connected to said center weldment in a manner to impart torque thereto;

b. positioning said body section of said make/break tool over a pipe length extending above said drilling deck and beneath said internal blow-out preventor or component thereof;

c. engaging said internal blow-out preventor or component thereof with a gripping tool, said gripping tool comprising a splined device for engaging said internal blow-out preventor or component thereof; and d. activating said linear actuators in order to make-up or break-out said internal blow-out preventor or component thereof.

21. The method of making up or breaking out an internal blow-out preventor or component thereof according to claim 20, wherein a tubular base section connects said body section to said drilling deck.

22. The method of making up or breaking out an internal blow-out preventor or component thereof according to claim 20, wherein said make/break tool is fixed to a rotary table and said rotary table is locked prior to activating said linear actuators.

23. The method of making up or breaking out an internal blow-out preventor or component thereof according to claim 20, wherein said make/break tool is fixed to said drill deck and locked against rotation prior to activating said linear actuators.

24. The method of making up or breaking out an internal blow-out preventor or component thereof according to claim 20, wherein a drive head providing torque to said internal blow-out preventor or component thereof is braked against rotation prior to activating said linear actuators.

* * * * *